United States Patent [19]

Harper, Jr.

[11] Patent Number: 4,718,199

[45] **Date of Patent: * Jan. 12, 1988**

[54] ORBITAL BARREL FINISHING MACHINE AND AUTOMATED SYSTEM THEREFOR

[76] Inventor: John F. Harper, Jr., 1334 Neipsic Rd., Glastonbury, Conn. 06033

[ * ] Notice: The portion of the term of this patent subsequent to Oct. 7, 2003 has been disclaimed.

[21] Appl. No.: 886,533

[22] Filed: Aug. 25, 1986

Related U.S. Application Data

[63] Continuation of Ser. No. 759,278, Jul. 26, 1985, Pat. No. 4,615,148.

[51] Int. Cl.[4] ..... B24B 31/02

[52] U.S. Cl. ..... 51/164.2; 241/175; 366/217

[58] Field of Search ..... 51/164.1, 164.2, 7, 51/313; 241/175; 366/217, 218; 494/33

[56] References Cited

U.S. PATENT DOCUMENTS

| | | | |
|---|---|---|---|
| 3,341,979 | 9/1967 | Davidson | 51/164.2 |
| 3,816,999 | 6/1974 | Dreher | 51/164.1 |
| 3,823,512 | 7/1974 | Koyayashi | 51/164.2 |
| 4,104,831 | 8/1978 | Koyayashi | 51/164.2 |
| 4,172,339 | 10/1979 | Balz | 51/164.2 |
| 4,232,486 | 11/1980 | Bumpe | 51/164.1 |

*Primary Examiner*—Harold D. Whitehead

*Attorney, Agent, or Firm*—Chilton, Alix & Van Kirk

[57] ABSTRACT

An orbital barrel finishing machine employs rotatable drums which are removable from the machine. A coupling member mounting a plurality of angularly spaced axially extending pins engages slots of a second coupling member to provide a rotational drive engagement for the removable drums. The drums are uncoupled from the drive engagement by axially displacing the drums. A releasable latch assembly is employed to secure the drums in the coupled drive position. The orbital barrel finishing machine is employed as a component of an integrated automatic finishing system wherein the rotatable drums may be automatically removed from the machine, unloaded, loaded and returned to the machine.

4 Claims, 9 Drawing Figures

ORBITAL BARREL FINISHING MACHINE AND AUTOMATED SYSTEM THEREFOR

This application is a continuation of pending application Ser. No. 759,278 filed on July 26, 1985, now U.S. Pat. No. 4,615,148, issued Oct. 7, 1986, and entitled "Orbital Barrel Finishing Machine And Automated System Therefor".

BACKGROUND OF THE INVENTION

The present invention generally relates to orbital-type machines which are employed for finishing the surfaces of various work pieces by centrifugal force. More particularly, the present invention relates generally to multi-drum orbital barrel finishing machines which receive abrasive media and work pieces for rotation about generally horizontally disposed axes.

Orbital barrel finishing machines are typically employed for deburring, radiusing, polishing and finishing the surfaces of a wide variety of stampings, forgings and machine components. The rate of surface abrasion of the work pieces is a function of the type of abrasive media, the speed with which the orbital finishing machine is operated, and the length of the operation of the orbital barrel finishing machine. While orbital barrel finishing machines have enjoyed wide popularity and have been widely employed in the surfaces finishing arts to obtain high quality surface finishing, the continued competitive mandates to reduce manufacturing and labor costs has resulted in the increasing desirability of automating the surface finishing process as much as possible. Accordingly, it is a principal aim of the present invention to provide a new and improved orbital barrel finishing machine which may be employed as an integral part of a highly automated materials finishing system and to provide an integrated automated surface finishing system.

BRIEF SUMMARY OF THE INVENTION

Briefly stated, the invention in a preferred form is an orbital barrel finishing machine comprising a plurality of rotatable drums each of which has a removable cover and forms an enclosure for receiving abrasion media and articles to be finished. The drums are removably mounted to a frame in an angularly spaced relationship relative to a central axis. A turret assembly rotates the drums in a first direction about the central axis. A gear assembly also rotates each of the drums about an orbital rotational axis through each of the drums in a direction which is opposite to the first direction. A pair of coupling members are employed for selectively engaging the drums in rotatable drive engagement in a first axial position of the drum and releasing the drive engagement in a second axial position of the drum so that the drum may be generally transversely removed from the frame. An indexing means in the form of a pneumatically driven axially projectable lock pin is employed to index each of the drums to a pre-established angular position relative to the central axis of rotation. One of the coupling members is a male coupling member which mounts a plurality of angularly spaced coupling pins. The coupling pins are received in complementary slots of a female coupling member. The drum is latched in the coupled engaged axial position by means of a releasable latch assembly.

In accordance with the invention, an automated orbital barrel finishing system comprises an orbital barrel finishing machine having a removable drum unit. Automatic robotic means are employed to automatically uncouple the drum unit from the rotational drive mechanism of the orbital finishing machine and to remove the drum unit from the machine. The automatic robotic means may also be employed to automatically reload the drum unit in the machine.

An object of the invention is to provide a new and improved orbital barrel finishing machine having removable drums.

Another object of the invention is to provide a new and improved orbital barrel finishing machine wherein the drums may be automatically removed from the machine for unloading and for reloading of the contents of the drums.

A further object of the invention is to provide a new and improved automated orbital barrel finishing system having automated means for loading and unloading the rotatable drums employed in the finishing system.

Further objects and advantages of the invention will become apparent from the specification and drawing.

DETAILED DESCRIPTION OF THE INVENTION

Figure 1:
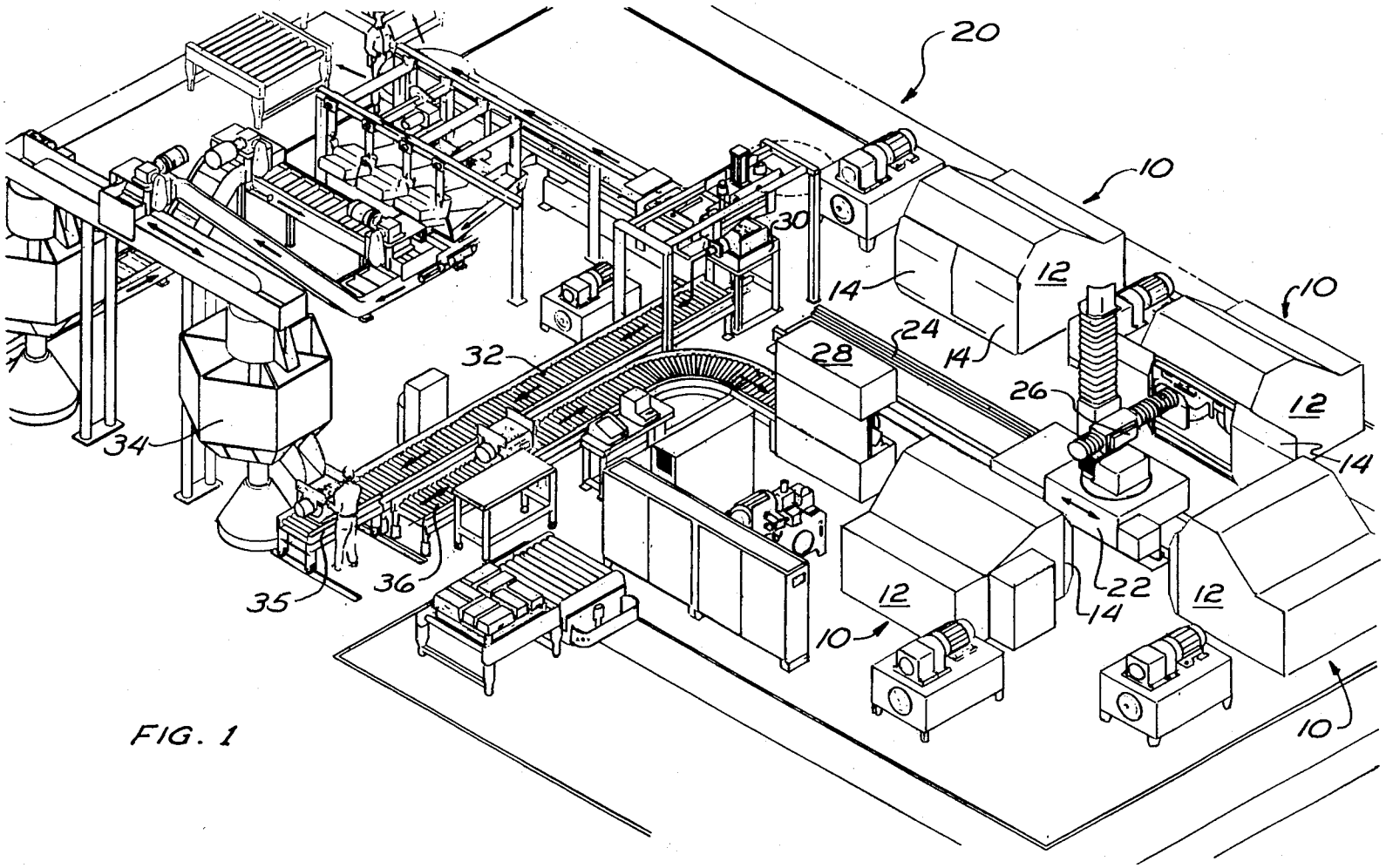
FIG. 1 is a perspective view illustrating an automated surface finishing system incorporating a plurality of orbital barrel finishing machines in accordance with the present invention.

With reference to the drawing wherein like numerals represent like parts throughout the several FIGURES, an orbital barrel finishing machine in accordance with the present invention is generally designated by the numeral 10. Orbital barrel finishing machine 10 has a shell-like enclosure 12 which generally encloses the machine. A pair of pneumatically controlled doors 14 slide transversely along roller tracks at the front of the enclosure to provide selective access to the major machine assemblies. Each machine has an assembly of four angularly spaced drums 16 which rotates about a central horizontal axis. Each drum also counterrotates about a second horizontal axis for effecting an abrasive finishing action due to the compound centrifugal force produced by the rotations.

Each drum 16 is adapted for receiving the work pieces to be finished and an abrasive media. A cover 18 is secured to the drum to seal the abrasive media and the work pieces in a generally fluid tight relationship within the drum. The orbital barrel finishing machine may be typically employed for deburring and radiusing the edges of a wide variety of stampings, forgings and machine components including gears, sprockets, levers, slides and the like and in the precision polishing and finishing of the surfaces of various articles such as airfoils.

With specific reference to FIG. 1, finishing machine 10 is preferably employed in an automated finishing system designated generally by the numeral 20. Automated system 20 comprises a robot 22 which bi-directionally traverses a rail 24 and is axially positionable about a vertical axis. Four substantially identical orbital barrel finishing machines 10 are positioned relative to the rail so that the robot may at a selected position along the rail align with the machines and axially rotate for removing and or returning a drum 16 to the machine. Robot 22 includes an arm assembly 26 which is adapted for disengaging a drum/cover unit and removing the drum/cover units from the finishing machine 10. The drum/cover unit is transported by the robot to a cover remover station 28 where the cover 18 is unlatched and retracted from the drum. The uncovered drum is then transported by the robot to a drum contents discharge station 30. The contents of the drum are removed at the discharge station. The emptied drum is then transported via a conveyor 32 to a media loading station 34. The abrasive media and the work pieces to be finished are loaded into the drum at station 34. The replenished drum is then transported via a cross-over conveyor 35 to conveyor 36 for return to the cover remover station 28. A cover 18 is then latched onto the drum 16, and the robot 22 returns the loaded drum/cover unit to machine 10. It will be appreciated that the foregoing system may be automaticallly controlled for sequential operation in a fashion wherein a drum of the orbital barrel finishing machine may be automatically removed from the machine, the contents of the drum emptied, new contents placed in the drum and the drum returned to the finishing machine.

With reference to FIGS. 2–7, orbital barrel finishing machine 10 comprises four substantially identical drums 16 and associated components and sub-assemblies. For purposes of describing the invention, each of the drums and the corresponding associated components are designated by the same element number with the element number being followed by the letter a, b, c, or d to distinguish a specific drum or component. It will be appreciated, however, that the invention herein has general applicability to any multi-drum orbital barrel finishing machine.

A platform 38 forms a generally rectangular base for the finishing machine. A pair of spaced upstanding pedestals 40 (only one being illustrated) form a support for mountably receiving a center shaft 44. The center shaft 44 is journaled to the pedestal by a pair of brackets 46 which are bolted in place. The center shaft 44 forms the central support shaft for the finishing machine and the central axis of rotation for the drum assembly.

A turret assembly designated generally by the numeral 50 is rotatably mounted to the center shaft 44 at the forward end thereof adjacent pedestal 40. The turret assembly 50 comprises a pair of generally parallel spaced support plates 52 and 54 having equal diameters. The support plates are rotatably mounted to the center shaft by means of bearing collars 56 and 58, respectively. Each of the collars 56 and 58 are configured for interiorly capturing a respective bearing assembly 60 and 62 to provide the rotatable mounting configuration. The radial periphery of the collars is adapted to securely receive the radially inward portions of the support plates in a fixed rotatable relationship therewith. Each of the foregoing bearing assemblies includes a plurality of rollers and a passageway for facilitating lubrication of the rollers. A generally cylindrical turret surface 64 coaxial with center shaft 44 connects between the support plates at the radial perphery thereof to exteriorly provide a turret for exteriorly mounting a pair of drive belts and interiorly enclosing a gear assembly designated generally by the numeral 66.

A hydraulically driven motor (not illusrated) is mounted at a forward end of the platform in general alignment with the foregoing described turret assembly. A pair of matched V-belts 70 and 72 connect for drive engagement between turret surface 64 and a drive wheel powered by the motor for rotatably driving the turret assembly to provide the prime drive mechanism of the machine. The speed of the motor is preferably controlled by an electric potentiometer and a servo control valve. The center shaft 44 remains stationary during the rotation of the turret assembly due to the engagement of a hydraulic failsafe brake (not illustrated).

An elongated sleeve 76 co-axial with center shaft 44 is rotatably mounted at opposing ends to the center shaft by a bearing collar 58 and a third bearing collar 78 which is substantially identical to collar 58. Collar 78 encloses a bearing assembly 80 to provide the rotatable mounting to the center shaft. A connecting plate 82 connects at the forward end of sleeves 76 and is bolted against support plate 54 to secure the sleeves in fixed axial position. A pair of axially spaced mounting members 84 and 86 are mounted at fixed axial positions to sleeves 76. Members 84 and 86 radially extend in generally parallel relationship to form four equiangularly spaced pairs of aligned slots for removably receiving removable drum units designated generally by the numeral 90. The slots are defined by generally C-shaped brackets 85 having an L-shaped section, a leg of which forms a stop 87 as more fully described below.

Drum 16 includes a rugged outer shell 92 having a plurality of integral leg structures 94 which are configured so that the drum may be supported by the leg structures in a generally upright orientation to form an upwardly opening receptacle. A shaft 96 integrally projects from one end of shell 92. The terminus of shaft 92 forms a uniform reduced diameter portion 98. A second shaft 100 integrally projects from the opposite end of shell 92 in axial alignment with shaft 96. Shaft 100 includes an intermediate shaft portion 102 and an end shaft portion 104 having respective uniform successive reduced diameters. Shafts 96 and 100 cooperate to form a rotational shaft for drum 16.

Figure 2:
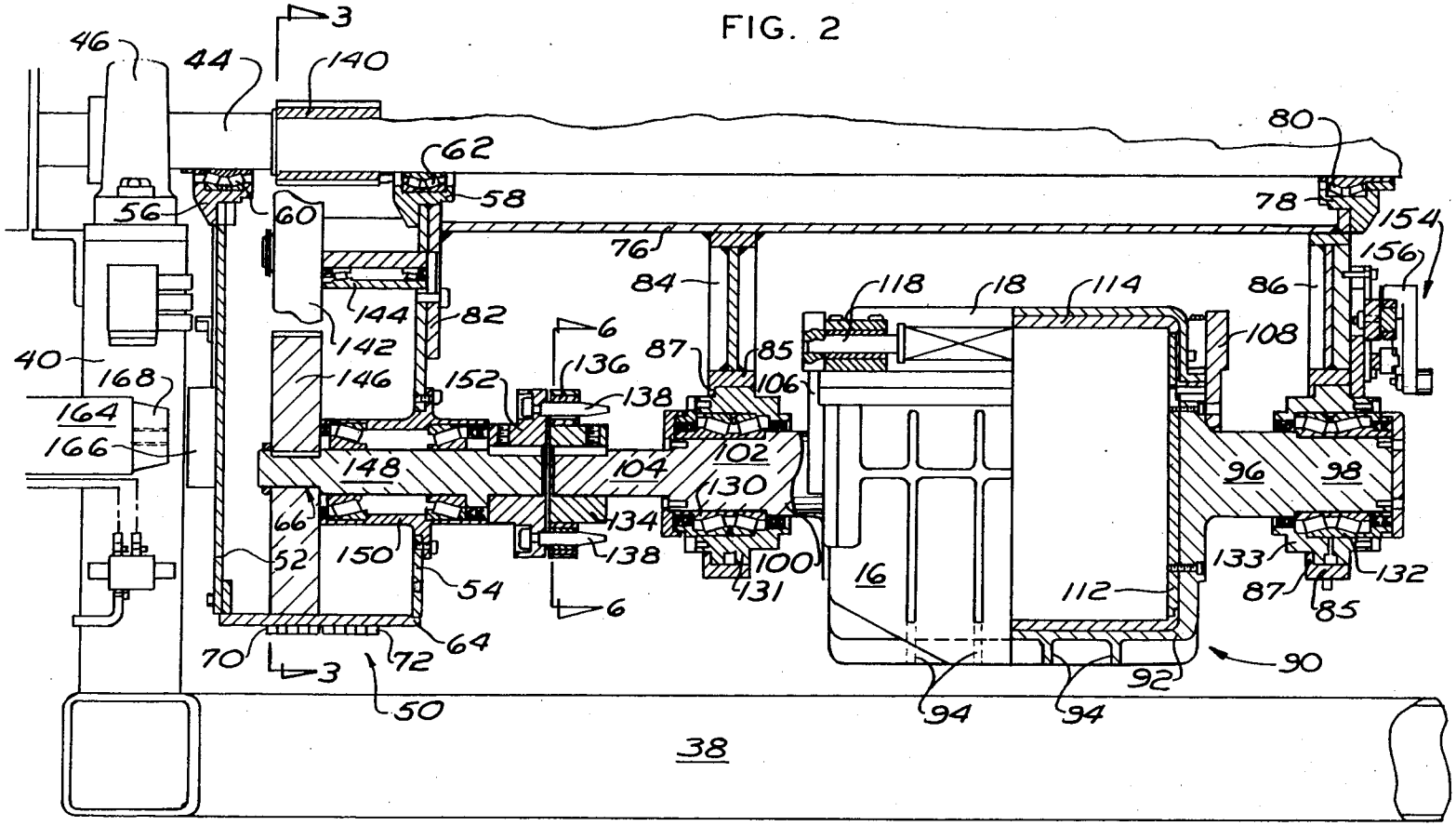
FIG. 2 is a fragmentary front sectional view, partly in section and partly broken away, of an orbital barrel finishing machine in accordance with the present invention.
Figure 5:
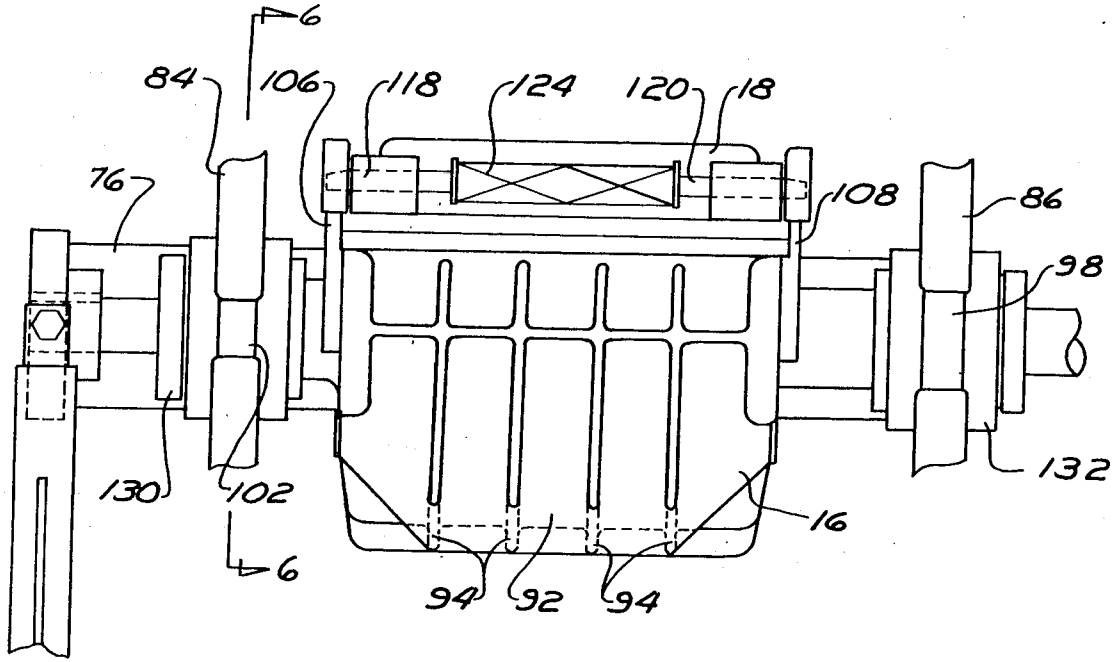
FIG. 5 is an enlarged fragmentary front view of a portion of the orbital barrel finishing machine of FIG. 2.
Figure 6:
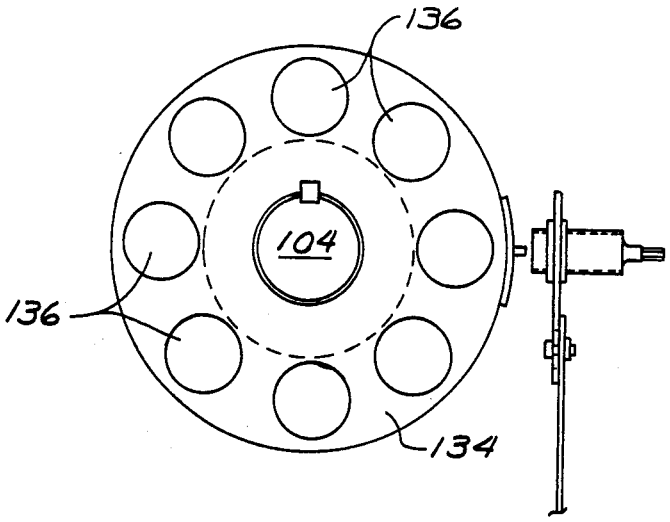
FIG. 6 is an end sectional view taken along the line 6—6 of FIG. 5.
Figure 7:
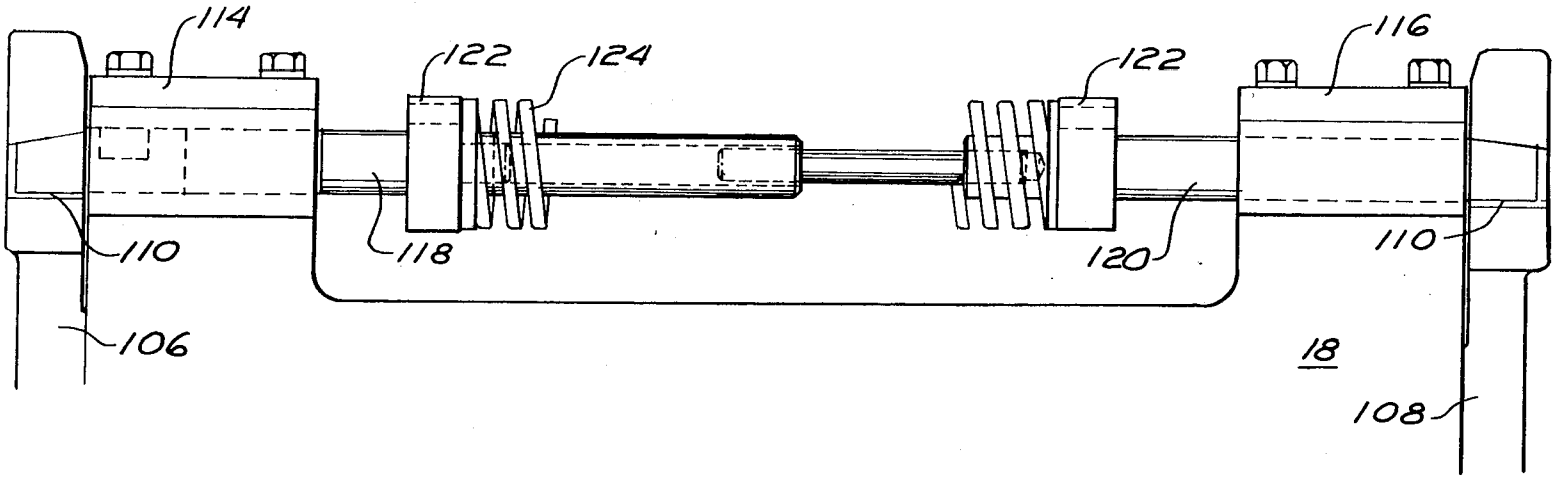
FIG. 7 is an enlarged front view, partly in phantom, of a lock mechanism employed with the drum of the orbital barrel finishing machine of FIG. 2.

With reference to FIGS. 2, 5 and 7, a pair of latch plates 106 and 108 are mounted at opposing ends of the shell 92 to form two pairs of axially aligned latch recesses 110 for securably latching the covers 18 to the drums. The shell and the cover are lined with steel wear plates 112 and 114, respectively, which cooperate to form a generally cylindrical enclosure for the abrasion media and the material or work pieces to be finished. The foregoing steel wear plates are replaceable and are coated with a special heat transfer cement to provide maximum heat transfer from the interior of the drums to the surrounding ambient environment.

With reference to FIG. 7, cover 18 includes two pairs of upstanding brackets 116 which slidably receive two pairs of axially retractable cooperating latch pins 118 and 120. Each of the foregoing latch pin pairs are slidably coupled at the ends thereof and include intermediate release flanges 122. A coil spring 124 is captured between the flanges to exert an axial bias for normally projecting the oppositely forced latch pins into corresponding latch recesses 110 formed in the retainer plates 106 and 108 of the drum. The foregoing latch assembly functions to securely latch the cover to the drum and also seal the cover and drum in a generally fluid tight relationship.

A bearing package 130 receives the intermediate portion of shaft 100 and is bolted to the shaft. Likewise a second bearing package 132 receives the intermediate portion of shaft 96 and is bolted to the shaft. Each of the foregoing bearing assemblies includes a plurality of angularly spaced rollers which are configured to provide rotation of the drum/cover assembly about a rotational axis formed by the shafts 96 and 100. Bearing packages 130 and 132 have outer casings 131 and 133, respectively, which are rotatable relative to the shafts. The casings are exteriorly shaped so that they may be closely axially received by brackets 85 as illustrated in FIG. 2. It should be appreciated that each of the four drum/cover assemblies 90 are mounted in substantially the same manner.

A female coupling member 134 is mounted in fixed rotational relationship at the reduced shaft end 104. Female coupling member 134 includes a plurality of angularly spaced axially extending through slots 136 which are adapted to receive corresponding coupling pins 138 as will be further described below.

Figure 3:
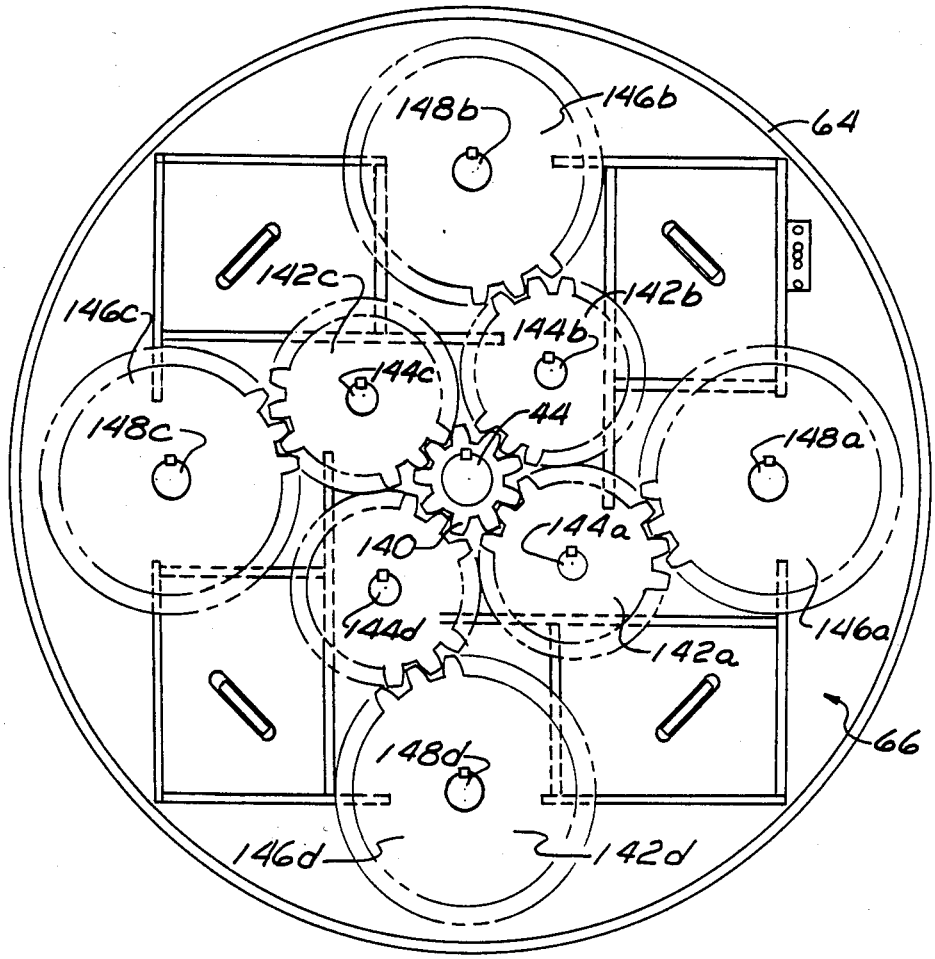
FIG. 3 is an end sectional view taken along the line 3—3 of FIG. 2.
Figure 4:
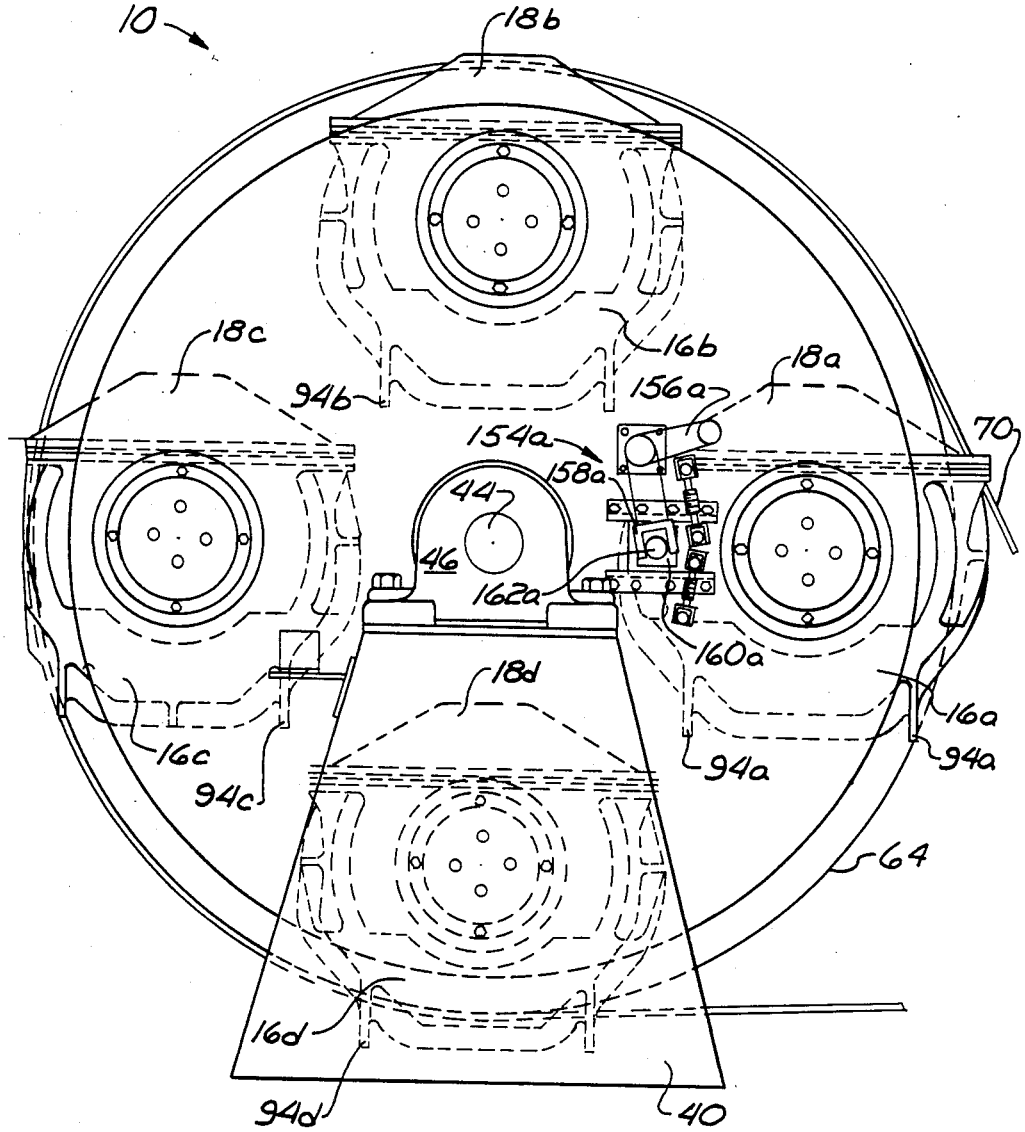
FIG. 4 is an end view, partly in phantom, of the orbital barrel finishing machine of FIG. 2.

The rotational drive for rotating each of the drums is transferred to the drum shafts by gear assembly 66. With reference to FIG. 3, a pinion gear 140 is mounted in fixed rotational relationship to center shaft 44. Four equiangularly spaced driver gears **142*a*, 142*b*, 142*c* and 142*d* are mounted for rotatable engagement with the fixed pinion gear 140. The driver gears are mounted for rotation about respective fixed shafts 144 which are mounted to support plate 54. Driver gears 142 mesh with corresponding driven gears 146 which are mounted in fixed rotational relationship to corresponding drive shafts 148**.

Each of the drive shafts 148 is rotatably received in a corresponding bearing sleeve 150. With reference to FIG. 2, the bearing sleeves 150 are mounted in equiangular spaced relationship to support plate 54 and generally extend axially through the support plate. The bearing sleeves 150 enclose a bearing assembly which provide for rotation of shafts 148 and hence driven gears 146 relative to the foregoing support plate.

A generally annular coupling plate 152 is mounted in fixed rotatable relationship with shaft 148 at the rear end thereof. Male coupling plate 152 mounts a plurality of axially (rearwardly) protruding coupling pins 138. The coupling pins 138 are angularly alignable with corresponding slots 136 in the female coupling member 134. The coupling pins are tapered to facilitate reception in the corresponding slots 136 upon axially displacing the female member into engagement with the male coupling plate to provide a rotational drive engagement between shaft 148 and shaft 100. It will be appreciated that the foregoing gear assembly 66 provides a mechanism wherein rotation of the turret assembly 50 by the motor produces a counter-rotation of each of the drums **16*a*, 16*b*, 16*c* and 16*d* whereby the drum assembly is rotating about the center shaft 44 in one direction and the drums are also each simultaneously rotating about the axis formed by shafts 90 and 100** in the opposite direction.

A drum latch assembly designated generally by the numeral 154 is provided for each of the removable drums and functions to latch the drums in the coupled axial position as illustrated in FIG. 2. Latch assembly 154 includes a bell crank 156 which is pivotally mounted to mounting member 86. A catch 158 extends from the terminus of the bell crank. A mounting plate 160 is fastened to the mounting member 86. A stop 162 axially protrudes from the mounting plate. The bell crank and stop are located so that catch 158 is releasably engagable with stop 162 to provide a latch for retaining the drum assembly in the coupled axial position.

An indexing brake 164 is mounted at the forward end of the machine forwardly of the turret assembly 50. Four equiangularly spaced members forming a forwardly opening slot 166 are mounted to support plate 52. Indexing brake 164 is a pneumatically driven brake which controls an axially positionable lock pin 168. The slots are angularly alignable with lock pin 168 upon rotation of the turret assembly. Lock pin 168 is generally tapered to conform with the taper of slot 166. The angular rotational position of the drum assembly may be indexed at the index position illustrated in FIG. 2 by operating the motor at a relatively low speed and by actuating the indexing brake so that the lock pin is projected into a slot 166. It should be appreciated that the foregoing indexing brake indexes both the angular position of the turret assembly and the angular rotational position of each of the drums.

In accordance with the present invention, each of the drums 16 may be removed from the machine for removal of the contents and reloading of the drum. A drum is removed from the assembly by first activating the indexed brake 164 to index the machine to the initial indexing angular position. The doors 14 are retracted to allow access to the drum unit 90. The latch assembly 154 is then released by forcing the bell crank 156 upwardly. Drum 16 is axially displaced (to the right in the drawing) so that the female coupling member 134 is withdrawn from the coupling pins 138. The bearing packages 130 and 132 also disengage from their respective retaining brackets 85 upon axially displacing the drum. The uncoupled drum is thus free to be transversely (forwardly) withdrawn from the machine. The releasing of the latch assembly, the axial displacement of the drum and the withdrawal of the drum is preferably accomplished by suitable manipulation of robot 22. It should be appreciated that the removed drum unit 90 essentially comprises drum 16, cover 18, shaft 96, shaft 100, bearing package 130, bearing package 132 and female coupling member 134. Each of the other drum units may likewise be sequentially removed from the machine as previously described.

After a drum unit 90 is removed from the finishing machine, the removed unit is transported to cover remover station 28. Cover remover station 28 includes an overhead pair of compressive arms which are lowered to engage the release flanges 122 of the cover latch mechanisms and axially compress the flanges and captured springs 124 so that the latch pins 118 and 120 are withdrawn from the latch recesses 110 of the drum thereby allowing the cover to be lifted from the drum for removal.

After the drum 16 has been emptied and reloaded and the cover 18 remounted and locked in place, the drum unit 90 is returned by the robot for loading into the finishing machine 10. The doors 14 are opened. If required, the machine is indexed to the proper initial locating position. The drum unit 90 is transversely moved into position so that drum 16 is disposed between members 84 and 86 and shafts 100 and 96 are received in corresponding brackets 85. The drum unit 90 is then axially shifted (to the left in the drawing) so that the female coupling member receives the coupling pins 138 and casings 131 and 133 engage stops 87 thereby rotatably coupling the drum unit to the support members 84 and 86. It will be appreciated that the coupling pins are tapered to provide a self-guiding feature although alignment of the pins and slots is provided by proper indexing of the machine and loading of the drum unit 90. The crank 156 is then forced downwardly so that the catch 158 engages the stop to lock the drum unit 90 in the coupled mounted position. The drum is now ready for orbital operation within the finishing machine.

Figure 8:
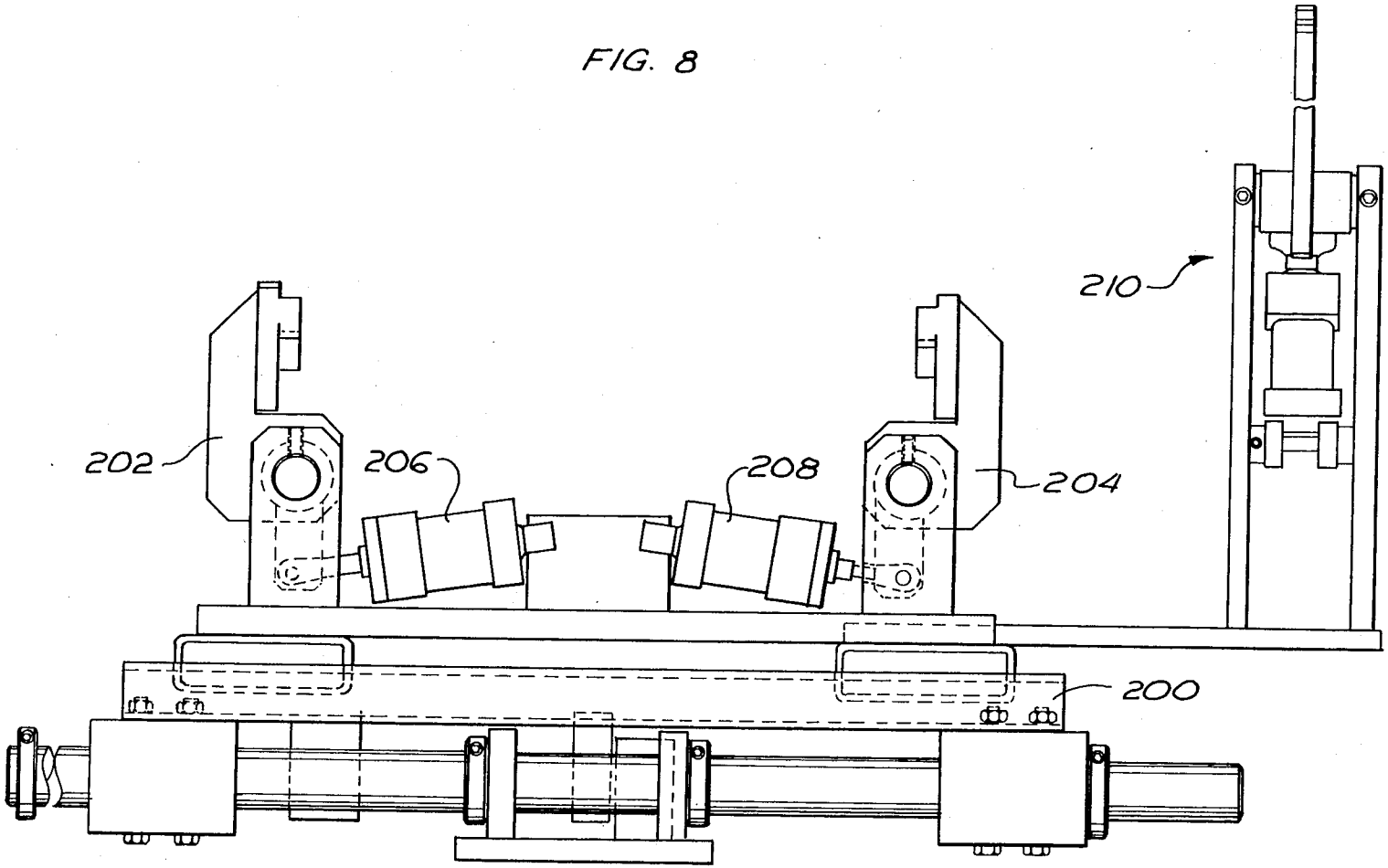
FIG. 8 is a fragmentary top plan view, partly in phantom, of a robot employed in the automated system of FIG. 1.
Figure 9:
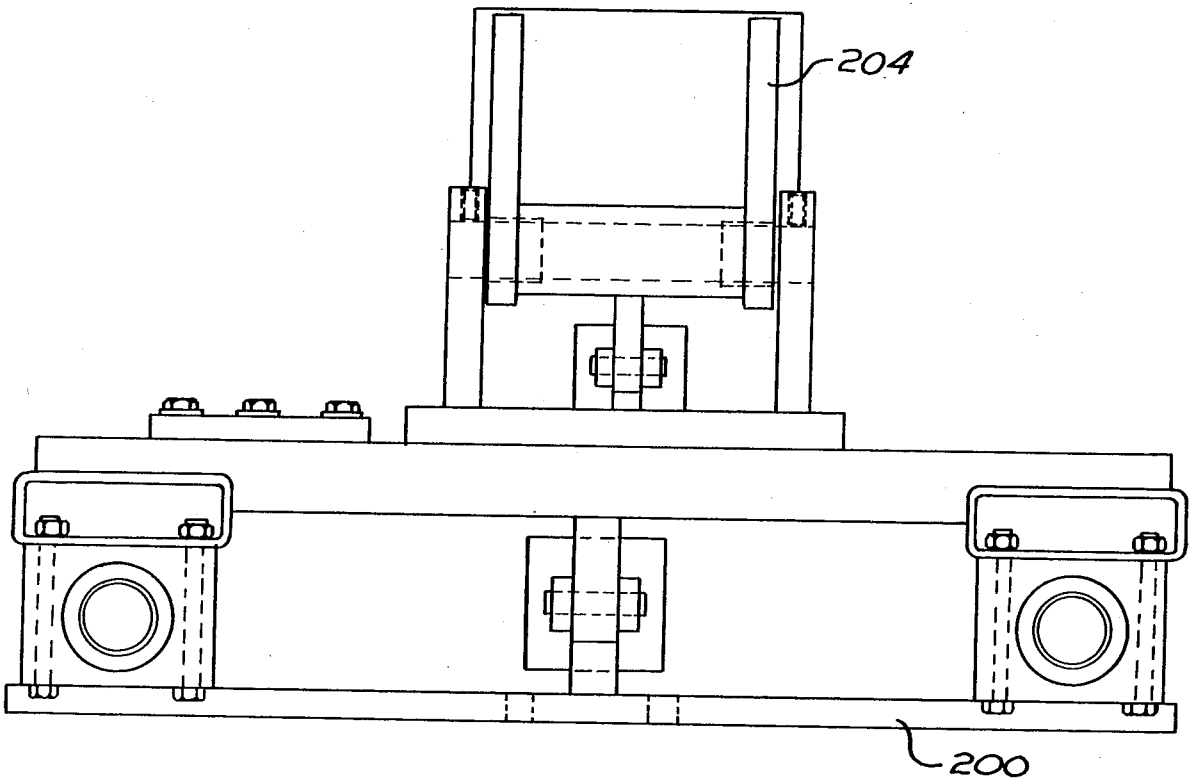
FIG. 9 is a fragmentary side elevational view of the robot of FIG. 8.

Although robot 22 may assume a variety of forms and configurations which are suitable for removing and loading a drum unit 90 into finishing machine 10 in accordance with the present invention, a preferred configuration for robot 22 is illustrated in FIGS. 8 and 9. A frame 200 pivotally mounts a pair of gripper arms 202 and 204. The gripper arms are spaced so that they may be positioned at opposite ends of the drum 16. A pair of hydraulic cylinders 206 and 208 may be selectively driven to pivot the gripper arms into engagement at opposite ends of the drum. The gripper arms are configured to facilitate the gripping interaction with the drums. A latch actuator assembly 210 is mounted at an outer lateral support of the frame to provide a mechanism for automatically releasing and engaging the drum latch assembly 154. The latch actuator includes a generally vertically pivotal arm which is configured at its terminus to have a catch for engaging the bell crank. Upon pivotal driving of the latch arm, the bell crank may be forced upwardly to release the latch mechanism so that the drum unit 90 is free for axial displacement and removal from the machine. Similarly, the bell crank may be pivoted downwardly by the latch actuator assembly to re-engage the drum latch assembly 154. Robotic assemblies (not illustrated) are provided for bidirectionally moving and rotating frame 200 and for automatically controlling and actuating the foregoing described robotic movements.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. An automated orbital barrel system comprising:

an orbital barrel finishing machine comprising:

a plurality of drums;

frame means to removably mount said drums in an angularly spaced relationship relative to a central axis;

turret means to rotate said drums in a first direction about said central axis;

orbital rotation means to rotate each said drum about an orbital rotational axis through each said drum in a second direction opposite said first direction;

drive engagement means to selectively couple each said drum to said orbital means for rotational drive engagement therewith, said drive engagement means comprising a plurality of angularly spaced coupling pins which extend parallel to said orbital rotational axis and in fixed axial relationship to said frame means and pin engagement means comprising a female member mounted in fixed relationship to each said drum and defining a plurality of angularly spaced slots which are symmetrically positionable relative to the orbital rotational axis of said drum and are alignable for receiving said coupling pins for rotatably coupling said drum to said orbital rotation means; and latch means actuable for securing said pins and female member in coupled relationship and releasable to permit axial disengagment of said female member from said coupling pins whereby said drum and associated female member may be removed as a unit from said frame means; and drum remover means engageable with a said drum unit for disengaging the said drum unit from rotational drive engagement with said orbital rotation means and removing the said drum unit from said orbital barrel machine.

2. The automated orbital barrel system of claim 1 wherein each said drum unit forms a generally unobstructed enclosure.

3. The automated orbital barrel system of claim 1 wherein said drum remover means comprises a pair of cooperating arms adapted to engage opposing exterior portions of said drum unit.

4. The automated orbital barrel system of claim 3 wherein said drum removed means further comprises a latch actuator arm for selectively releasing said latch means.

* * * * *